US008643462B2

(12) United States Patent
Lee et al.

(10) Patent No.: US 8,643,462 B2
(45) Date of Patent: Feb. 4, 2014

(54) SWITCH MODULE

(75) Inventors: Yu-Lung Lee, Miaoli County (TW); Jung-Hui Hsu, Taipei County (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 511 days.

(21) Appl. No.: 12/940,200

(22) Filed: Nov. 5, 2010

(65) Prior Publication Data

US 2012/0067708 A1 Mar. 22, 2012

(30) Foreign Application Priority Data

Sep. 17, 2010 (TW) ..... 99131721 A

(51) Int. Cl.

| | |
|---|---|
| ***H01H 61/00*** | (2006.01) |
| ***H01H 39/00*** | (2006.01) |
| ***H01H 71/16*** | (2006.01) |
| ***H01H 15/00*** | (2006.01) |
| ***H01C 7/10*** | (2006.01) |

(52) U.S. Cl.

USPC ..... 337/14; 337/34; 337/52; 338/20; 338/21; 200/332

(58) Field of Classification Search

USPC ..... 337/14, 34, 52; 338/20, 21; 200/332
See application file for complete search history.

(56) References Cited

U.S. PATENT DOCUMENTS

| | | | | | |
|---|---|---|---|---|---|
| 3,622,941 | A | * | 11/1971 | Wetmore | 439/410 |
| 4,134,092 | A | * | 1/1979 | Lavigne et al. | 337/298 |
| 4,237,513 | A | * | 12/1980 | Foldes | 361/103 |
| 4,575,618 | A | * | 3/1986 | Rosenzweig | 219/535 |
| 4,704,594 | A | * | 11/1987 | Krasser | 337/66 |
| 4,881,908 | A | * | 11/1989 | Perry et al. | 439/161 |
| 5,047,891 | A | | 9/1991 | Nedriga | |
| 5,198,791 | A | * | 3/1993 | Shibayama et al. | 337/31 |
| 5,200,875 | A | * | 4/1993 | Yoshioka et al. | 361/56 |
| 5,231,367 | A | * | 7/1993 | Ikeda et al. | 337/28 |
| 5,241,445 | A | * | 8/1993 | Karasawa | 361/104 |
| 5,276,422 | A | * | 1/1994 | Ikeda et al. | 337/28 |
| 5,311,164 | A | * | 5/1994 | Ikeda et al. | 337/28 |
| 5,373,414 | A | * | 12/1994 | Kondo | 361/129 |
| 5,933,310 | A | * | 8/1999 | Eggendorfer | 361/104 |
| 5,973,587 | A | * | 10/1999 | Hofsass | 337/377 |
| 6,636,403 | B2 | * | 10/2003 | McLoughlin et al. | 361/103 |
| 7,741,946 | B2 | * | 6/2010 | Ho | 337/5 |
| 8,217,750 | B2 | * | 7/2012 | Machida | 337/32 |
| 2007/0200657 | A1 | * | 8/2007 | Tsai et al. | 338/21 |
| 2008/0129440 | A1 | * | 6/2008 | Ho | 337/5 |
| 2011/0109421 | A1 | * | 5/2011 | Lee et al. | 337/112 |
| 2012/0068807 | A1 | * | 3/2012 | Hsu et al. | 337/14 |

FOREIGN PATENT DOCUMENTS

| | | | |
|---|---|---|---|
| CN | 2741173 | Y | 11/2005 |

* cited by examiner

*Primary Examiner* — Bradley Thomas
(74) *Attorney, Agent, or Firm* — Rosenberg, Klein & Lee

(57) ABSTRACT

A switch module applied for a power supply system is disclosed. The switch module comprises a power switch, an insulating member, a surge absorber and a pyrocondensation belt. The power switch is connected with the power supply system, the insulating member is set on the power switch, the surge absorber is electrically connected with the power switch and adjacent to the power switch, the pyrocondensation belt is connected with the surge absorber and the insulating member. The pyrocondensation belt shrinks with a temperature of the surge absorber. When the insulating member is in the initial state, the insulating member does not affect the power switch. The insulating member makes the power switch off when the shrinkage degree of the pyrocondensation belt develops enough to block the power switch from being on.

12 Claims, 8 Drawing Sheets

SWITCH MODULE

BACKGROUND OF THE INVENTION

1. Field of the Invention

The present invention relates to a switch module, in particular, to a switch module with automatic and irreversible disconnection due to the shrinkage of pyrocondensation belt.

2. Description of Related Art

To avoiding the transient voltage surge of the power supply system from damaging the electronic components, surge absorbers would usually be applied on the electrical circuit, such as MOV (Metal Oxide Varistor in short), and so on. The surge absorber absorbs the transient voltage surge, and thus generates high thermal energy. The generated high thermal may cause hazards of fire or burning which may damage surrounding electronic components of the surge absorber.

The conventional solution to resolve regarding hazards is to add thermal cutoff fuses connected between the surge absorber and the power supply system. By melting the thermal cutoff fuse while absorbing too much heat, the electrical circuit and the power supply system are disconnected. However, in this case, the temperature of the surge absorber is actually higher than that of the thermal cutoff fuse. Besides, the service life of the surge absorber is finite. Accordingly, it may have risky possibility of damages of surrounding electronic components while the surge absorber is on fire and the thermal cutoff fuse then melts, or while the surge absorber is on fire and the thermal cutoff fuse melts at the same time.

SUMMARY OF THE INVENTION

The present invention provides a switch module applying a pyrocondensation belt connecting with a surge absorber. The pyrocondensation belt shrinks in accordance with the temperature of the surge absorber. Due to the shrinkage of the pyrocondensation belt, an insulating member may blocks a power switch from being on when the shrinkage degree of the pyrocondensation belt develops enough, so that the power switch disconnects automatically and restrains the manual operation thereof in order to be prevented from fire.

The present invention provides a switch module, applied for a power supply system, including a power switch being connected with the power supply system; an insulating member being set on the power switch; a surge absorber being electrically connected with the power switch and adjacent to the power switch; and a pyrocondensation belt being connected with the surge absorber and the insulating member and being shrinking in accordance with a temperature of the surge absorber. The insulating member does not affect the power switch when the insulating member is in the initial state; the insulating member makes the power switch off when the shrinkage degree of the pyrocondensation belt develops enough to block the power switch from being on.

The present invention provides a switch module, applied for a power supply system, including: a power switch being connected with the power supply system; an insulating member being set on the power switch; a surge absorber being electrically connected with the power switch and adjacent to the power switch; and a pyrocondensation sleeve being sleeved onto an exterior periphery of the surge absorber and being connected to the insulating member; the pyrocondensation sleeve shrinking in accordance with a temperature of the surge absorber. The insulating member does not affect the power switch when the insulating member is in the initial state; the insulating member makes the power switch off when the shrinkage degree of the pyrocondensation sleeve develops enough to block the power switch from being on.

The present invention provides a switch module, applied for a power supply system, including: a power switch being connected with the power supply system; an insulating member being set on the power switch; a surge absorber being electrically connected with the power switch and adjacent to the power switch; and a pyrocondensation sleeve being sleeved onto the surge absorber, the power switch and the insulating member; the pyrocondensation sleeve shrinking in accordance with a temperature of the surge absorber. The insulating member does not affect the power switch when the insulating member is in the initial state; the insulating member makes the power switch off when the shrinkage degree of the pyrocondensation sleeve develops enough to block the power switch from being on.

Accordingly, the invention is characterized by that the insulating member moves to block the power switch due to the shrinkage of pyrocondensation belt ahead of the failure of the surge absorber. Furthermore, the manual operation for making the power switch on is also prevented. Therefore, double protections, the automatic disconnection of the power switch and the irreversible disconnection, are met thereby.

In order to further understand the techniques, means and effects the present invention takes for achieving the prescribed objectives, the following detailed descriptions and appended drawings are hereby referred, such that, through which, the purposes, features and aspects of the present invention can be thoroughly and concretely appreciated; however, the appended drawings are merely provided for reference and illustration, without any intention to be used for limiting the present invention.

DETAILED DESCRIPTION OF THE PREFERRED EMBODIMENTS

Figure 1A:
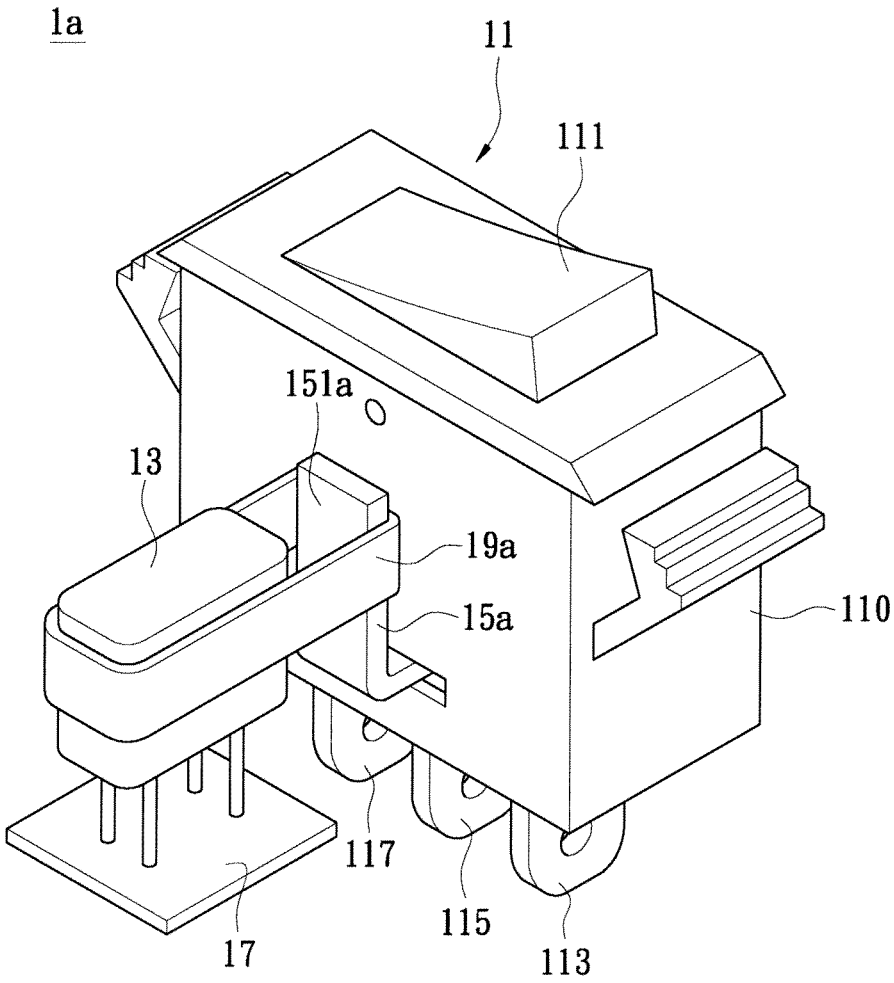
FIGS. 1A and 1B are perspective views of one embodiment of a switch module according to the present invention.
Figure 1B:
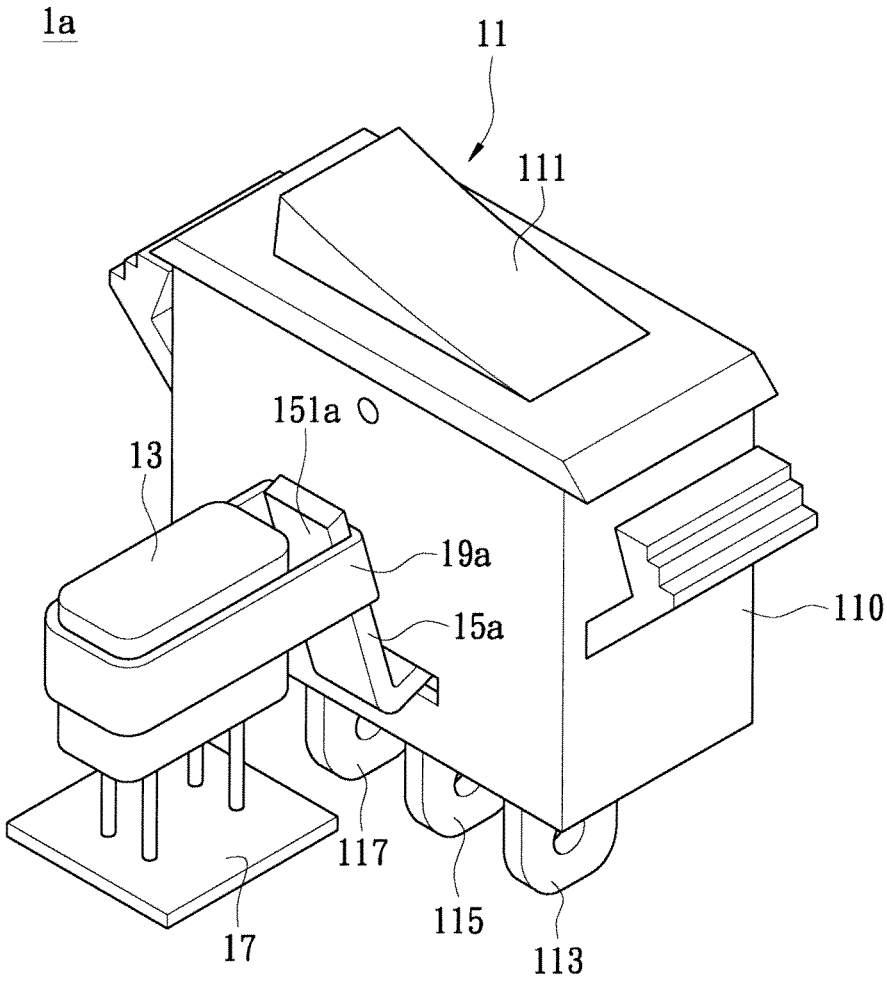

With respect to FIGS. 1A and 1B, a switch module according to one embodiment of the present invention is disclosed. The switch module 1*a* includes a power switch 11, a surge absorber 13, an insulating member 15*a* and a pyrocondensation belt 19*a*. The insulating member 15*a* is set on and inserted into the power switch 11. The surge absorber 13 is arranged on a printed circuit board 17 and adjacent to the power switch 11. The pyrocondensation belt 19*a* is connected to the surge absorber 13 and the insulating member 15*a*.

In this embodiment, the power switch 11 includes a casing 110, an operation portion 111, a first conductive member 113 and a second conductive member 115. The quantity of the conductive members may be two or three and is not restrained. In other words, the power switch 11 may further include a third conductive member 117. The first, second third conductive members 113, 115 and 117 are inserted into the casing 110, which means there are partial portions of these conductive members 113, 115 and 117 contained inside the casing 110, and other portions of these conductive members 113, 115 and 117 exposed out of the casing 110.

The first or second conductive members 113, 115 could be metal conductor, such as connector lugs, to electrically connects a power via a wire (not shown in FIGS. 1A and 1B), while the third one 117 is for grounding. For example, the first conductive member 113 connects to home use power supply system or the other power supply system, and the second conductive member 115 connects to the surge absorber 13. Furthermore, the first and second conductive member 113, 115 could swap for each other.

The operation portion 111 is detachably fixed on a lid of the casing 110, such as by a pivotal or engaged manner. The operation 111 is for manual manipulation to switch the electrical connection or disconnection between the first and second conductive members 113, 115, so that the power switch 11 is at on or off status. In practice, there is no restriction on the structure of the power switch 11, and it could be any switch such as a rocker switch or a push switch. The operation principle of the rocker switch or the push switch is known by the person skilled in the art, and therefore is omitted herein.

The technical feature of the present invention is the shrinkage of the pyrocondensation belt 19*a* due to the heat from the surge absorber 13. When the shrinkage degree is as much as enough, the insulating member 15*a* inserted into the casing 110 is pulled or taken to block the power switch 11 (as shown in FIG. 1B) and the switch module 1*a* is off before the surge absorber 13 is on fire or broken down. For example, the insulating member 15*a* disconnects the second conductive member 115 from the first conductive member 113, so that the power switch 11 turns to off status from on status.

It is noted that the shrinkage of the pyrocondensation belt 19*a* is irreversible. When the insulating member 15*a* blocks the connection between the first and second conductive members 113, 115, the operation portion 111 is regarded as failure, such as the operation portion 111 is unable to press or unable to switch even after press.

In practice, the structure and the configuration of the insulating member 15*a* are not limited. In this embodiment, the insulating member 15*a* includes a push-pull lever 151*a* and an extension portion (not shown in FIGS. 1A and 1B). The push-pull lever 151*a* is disposed outside the casing 110 to connect the insulating member 15*a* and the pyrocondensation belt 19*a* while the extension portion is arranged inside the casing 110. The surge absorber 13 and the insulating member 15*a* are at the same side of the casing 110 and there is a gap between them. When the insulating member 15*a* is at an initial status, there is a distance between the push-pull lever 151*a* and the casing 110.

The surge absorber 13 is configured as cubic or disc. The surge absorber 13 includes at least one surge absorption member, such as Zenner diode or Metal Oxide Varistor (MOV). The surge absorber 13 has at least two pins respectively connecting to the second conductive member 115 and the electronic component of the printed circuit board 17. The surge absorber 13 is used for absorbing the surge from the power switch 11 or lightning and to transform the surge energies into heat energies in order to protect electronic components.

The pyrocondensation belt 19*a* could be configured as belt or annularity. If the pyrocondensation belt 19*a* is configured as belt, the pyrocondensation belt 19*a* may stick to the surge absorber 13 and the push-pull lever 151*a* of the insulating member 15*a* via adhesion. If the pyrocondensation belt 19*a* is configured as annularity, such as pyrocondensation sleeve, the pyrocondensation belt 19*a* may encircle the surge absorber 13 and the insulating member 15*a*, as shown in FIG. 1A. The surge absorber 13 is adjacent to the push-pull lever 151*a* of the insulating member 15*a*, but with a gap, when the pyrocondensation belt 19*a* does not shrinkage due to the heat.

In the case the first and second conductive members 113, 115 conduct with each other. The temperature of the pyrocondensation belt 19*a* raises in accordance with the heat from surge absorber 13. When the temperature of the pyrocondensation belt 19*a* raises to an operating temperature range $[T_1, T_2]$ thereof, the pyrocondensation belt 19*a* shrinks sharply. The push-pull lever 151*a* is pulled by the pyrocondensation belt 19*a* and moves or bends forward the surge absorber 13, as shown in FIG. 1B, so as to block the connection of the first and second conductive members 113, 115.

Figure 3:
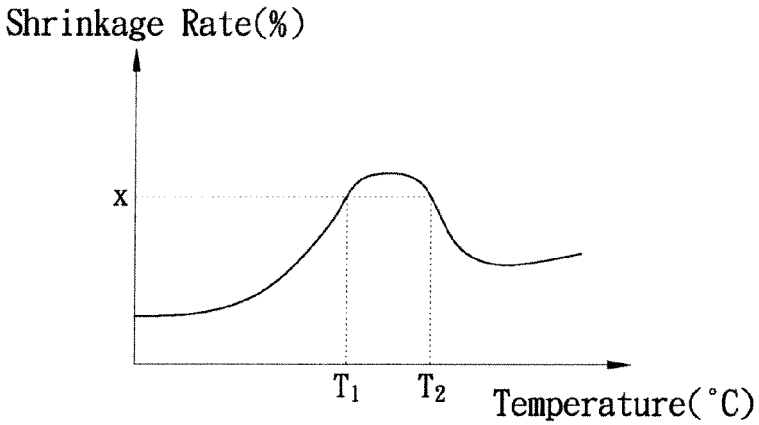
FIG. 3 is a characteristic curve diagram of one embodiment of pyrocondensation belt according to the present invention.

With respect to FIG. 3, a characteristic curve design figure of an embodiment according to the pyrocondensation belt 19*a* is illustrated. A selected shrinkage rate S is chosen to equal to or be higher than a predetermined shrinkage rate x % in accordance with the operating temperature range $[T_1,T_2]$. The selected shrinkage rate S could be the transverse shrinkage rate of the pyrocondensation belt 19*a*. When the pyrocondensation belt 19*a* meets the predetermined shrinkage rate x %, the resulting deformation is as much as enough to move or pull the push-pull lever 151*a* to block the connection of the first and second conductive members 113, 115.

The formula 1 of the shrinkage rate S is mentioned below.

$$S = \frac{L_0 - L}{L_0} \times 100\%,$$

wherein $L_0$ represents the transverse length of the pyrocondensation belt 19*a* before shrinkage, and L represents the transverse length of the pyrocondensation belt 19*a* after shrinkage.

It is noted that the pyrocondensation belt 19*a* could enclose or stick to the surge absorber 13 and the insulating member 15*a* when the switch module 1 completes manufacture. When the switch module 1 in use, the pyrocondensation belt 19*a* shrinks in correspond to the temperature of the surge absorber 13. The shrinkage force thereby blocks the connection between the first and second conductive members 113, 115. Due to the irreversible feature of the shrinkage of the pyrocondensation belt 19*a*, the disconnection of the power switch 11 is irreversible as well. Therefore, the surge absorber 13 is prevented from the fire due to the keeping warm-up, so that the safety utilization of electric power is guaranteed.

In this embodiment, the material of the pyrocondensation belt 19*a* is chosen free, but the maximum of the operating temperature range $[T_1,T_2]$ of the pyrocondensation belt 19*a* should be the critical temperature of the surge absorber 13, at which temperature the surge absorber 13 fails. Therefore, the sharp shrinkage of the pyrocondensation belt 19*a* happens just right before the failure of the surge absorber 13. For example, the critical temperature of the surge absorber 13 is 150, and the operating temperature range $[T_1,T_2]$ of the pyrocondensation belt 19*a* is 125 to 150. During 125 to 145, the shrinkage rate of the pyrocondensation belt 19*a* has been 40 to 60 so as to make the power switch 11 off before the surge absorber 13 fails.

Figure 2A:
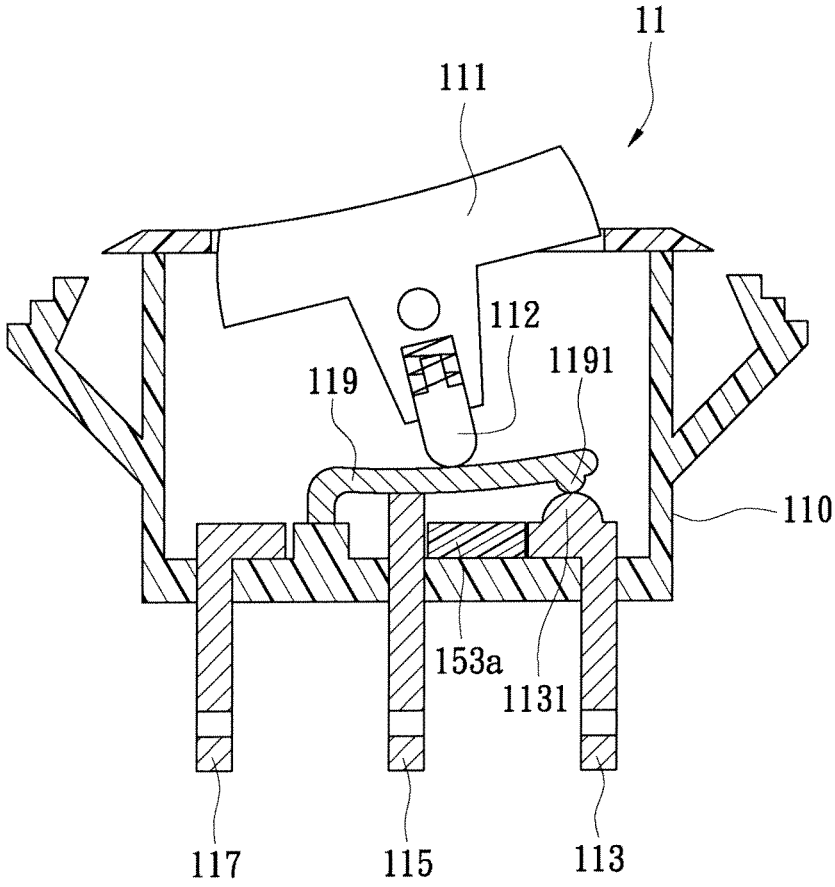
FIGS. 2A and 2B are perspective views of one embodiment of a power switch of a switch module according to the present invention.

For substantially description about how the insulating member 15*a* disconnects the power switch 11, referring to FIG. 2A, an embodiment of the power switch of the switch module and the insulating member of the switch module is illustrated. The power switch 11 includes the casing 110, the operation portion 111, the first conductive member 113, the second conductive member 115, the third conductive member 117, an elastic sheet 119, and a protrusion member 112 disposed in the casing 110. Moreover, the extension portion 153*a* of the insulating member 15*a* is set inside the casing 110 to be adjacent to the first and second conductive members 113 and 115.

One end of the elastic sheet 119 is connected to the interior of the casing 110, and fixedly connected to the second conductive member 115 and alternatively connected to the first conductive member 113. In practice, the second conductive member 115 could be integrally made with the elastic sheet 119. In one embodiment, the first conductive member 113 includes a first contact portion 1131, and the elastic sheet 119 includes a second contact portion 1191. The first and second conductive members 113, 115 conduct with each other by the contact between the first and second contact portions 1131, 1191. The first and second contact portions 1131, 1191 could be golden, silver or solder balls soldering on the first and second conductive members 113, 115. Alternatively, the first and second contact portions 1131, 1191 could be protrusion forming on the first and second conductive members 113, 115.

The protrusion member 112 connects the operation portion 111. In one embodiment, there is a resilient member (not shown in FIG. 2A) disposed between the operation portion 111 and the protrusion member 112, so as to keep the contact between protrusion member 112 and the operation portion 111. The protrusion member 112 deforms the elastic sheet 119 bending by the movement of the operation portion 111. When the protrusion member 112 withstands against the elastic sheet 119, the first and second contact portions 1131, 1191 connects with each other. At this moment, the power switch 1 is on, as shown in FIG. 2A. When the insulating member 15*a* is at initial status, the extension portion 153*a* does not affect the connection between the first and second contact portions 1131, 1191.

Figure 2B:
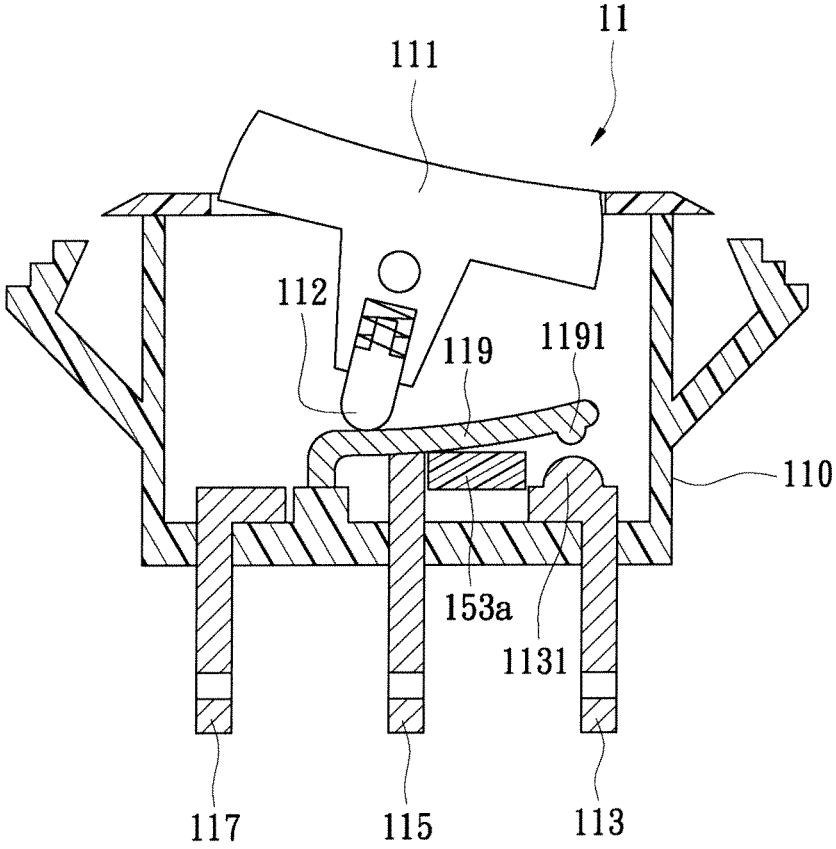

When the surge absorber 13 absorbs surge and starts to warm up, the pyrocondensation belt 19*a* warms up as well due to the heat conduction. When the temperature of the pyrocondensation belt 19*a* meets the maximum of the operating temperature range $[T_1,T_2]$ of the pyrocondensation belt 19*a*, the pyrocondensation belt 19*a* shrinks to a certain degree with the predetermined shrinkage rate. At the same time, the pull-push lever 151 moves the extension portion 153*a* in accordance with the shrinkage of the pyrocondensation belt 19*a*. In this embodiment, the extension portion 153*a* moves forward the elastic sheet 119 and further to push the elastic sheet 119 away from the first conductive member 113, so that the first conductive member 113 disconnects the second conductive member 115, as shown in FIG. 2B.

The movement of the extension portion 153*a* is irreversible, and therefore the power switch 11 keeps off. The operation portion 111 could not control the elastic sheet 119 moving back to connect the first conductive member 113, which means the operation portion 111 now is failing and the safety utilization of electric power is guaranteed.

Figure 4A:
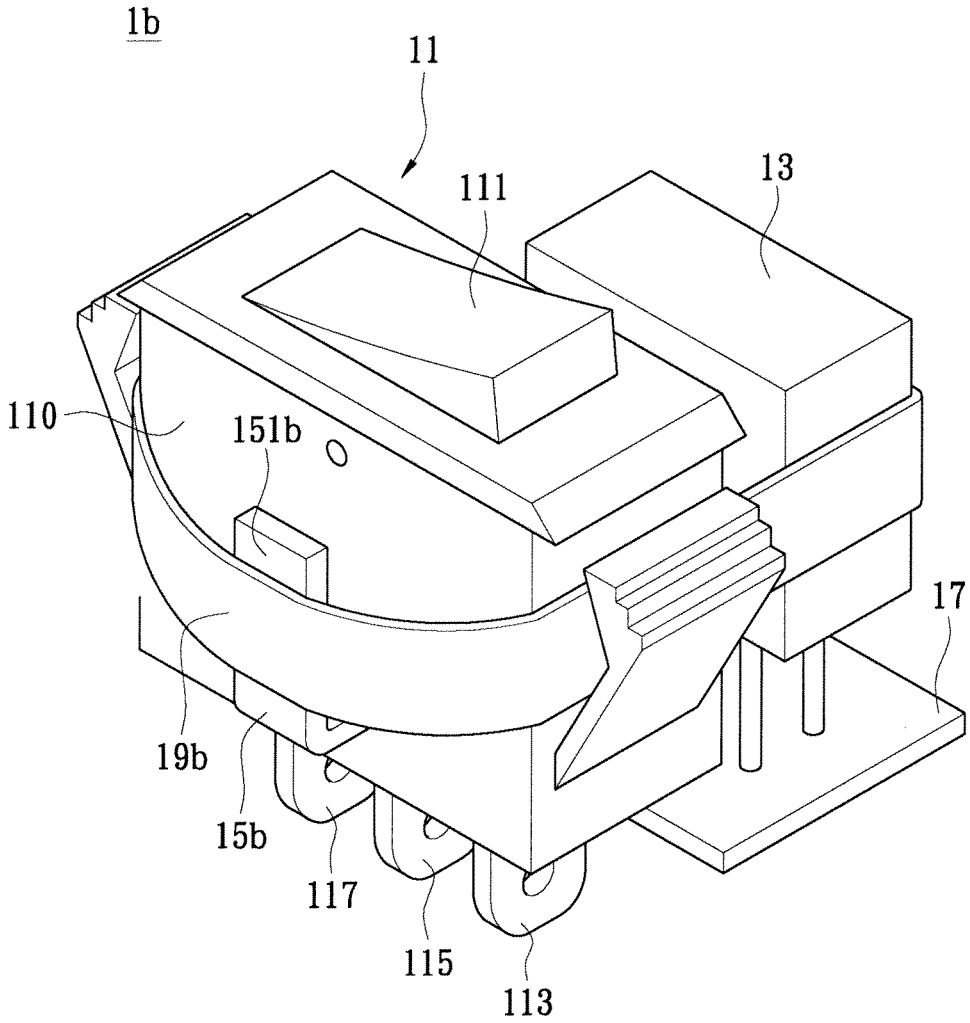
FIGS. 4A and 4B are perspective views of another one embodiment of the switch module according to the present invention.

With respect to FIG. 4A, another one embodiment according to the present invention is illustrated. The power switch 1*b* is configured like the power switch 1*a*. The difference between them are the surge absorber 13 and the insulating member 15*b* are arranged at different sides of the casing 110 in the power switch 1*b*, and the pyrocondensation belt 19*b* further connects the power switch 11 except the surge absorber 13 and the insulating member 15*b*.

For example, the pyrocondensation belt 19*a* is configured as annularity, such as pyrocondensation sleeve encircling the power switch 11, the surge absorber 13, and the insulating member 15*b*. When the temperature of the pyrocondensation belt 19*b* hasn't met the maximum of the operating temperature range $[T_1,T_2]$ thereof, there is a gap between the pull-push lever 151*b* and the casing 110, as in FIG. 4A.

Figure 4B:
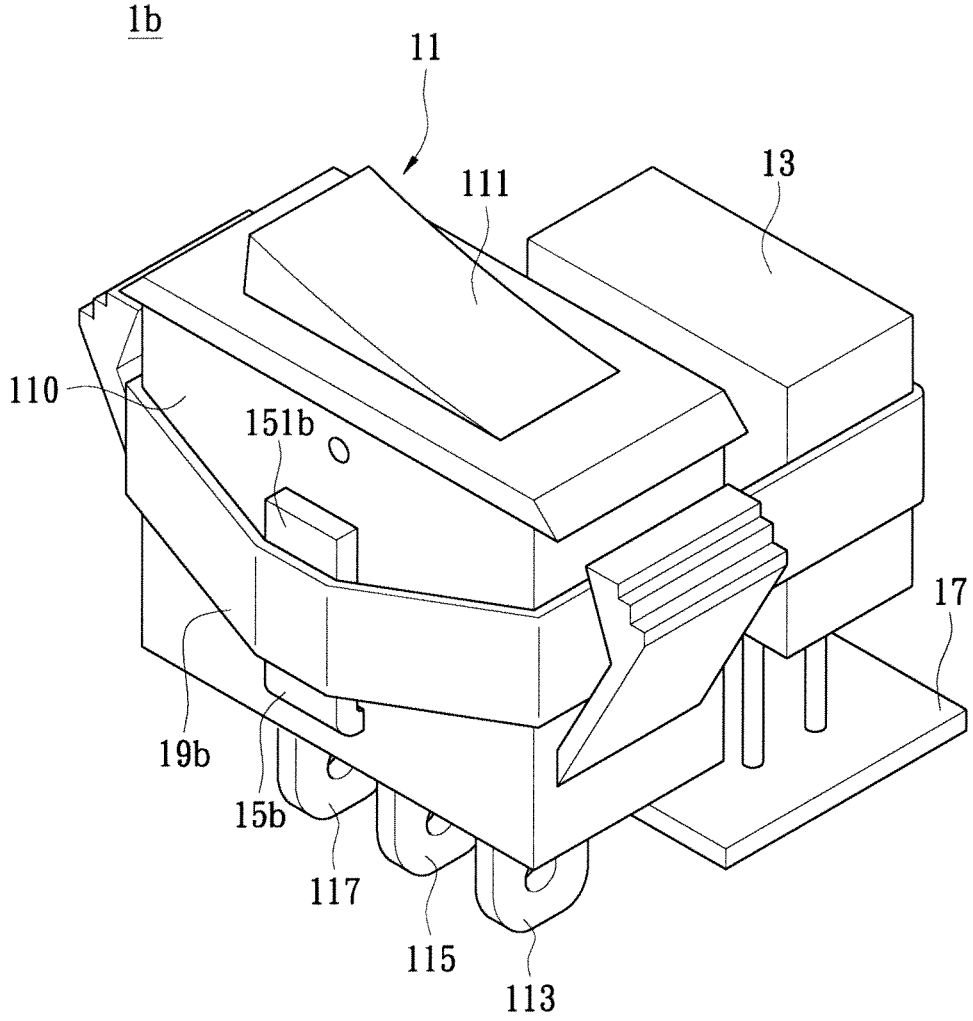

When the surge absorber 13 absorbs surge and starts to warm up, the pyrocondensation belt 19*b* warms up as well due to the heat conduction. When the temperature of the pyrocondensation belt 19*b* meets the maximum of the operating temperature range $[T_1,T_2]$ of the pyrocondensation belt 19*b*, the pyrocondensation belt 19*b* shrinks to a certain degree with the predetermined shrinkage rate. At the same time, the pull-push lever 151*b* moves forward the casing 110 in accordance with the shrinkage of the pyrocondensation belt 19*b*, as shown in FIG. 4B.

Figure 5A:
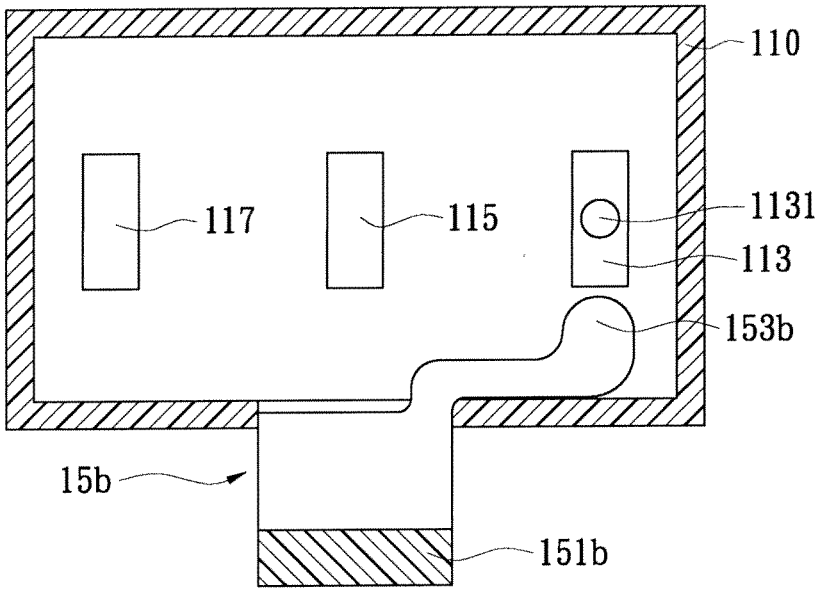
FIGS. 5A and 5B are perspective views of another one embodiment of a power switch of a switch module according to the present invention.
Figure 5B:
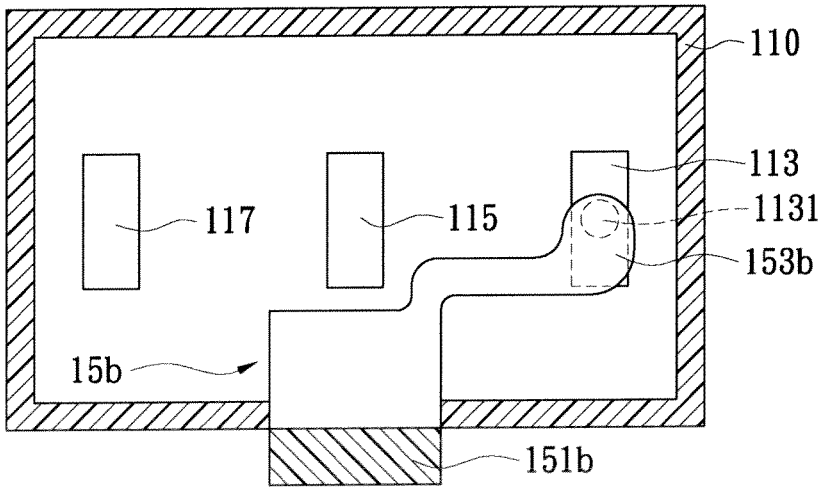

In addition, referring FIGS. 5A and 5B, a top view of the second embodiment of the switch module is illustrated. When the pyrocondensation belt 19*b*, in FIG. 5A, hasn't met the maximum of the operating temperature range $[T_1,T_2]$ thereof, the extension portion 153*b* is just adjacent to the first portion 1131 of the first conductive member 113 and the size of the extension portion 153*b* is appropriately larger than that of the first contact portion 1131.

The pyrocondensation belt 19*b* works with the predetermined shrinkage rate, the deformation is as much as enough to take the pull-push lever 151*b* to move the extension portion 153*b*. The extension portion 153*b* moves to the position between the first and the second contact portions 1131, 1191 (the second contact portion 1191 is not shown in FIG. 5B, but can be known from FIG. 2A) to block the connection between the first and second conductive members 113, 115, as in shown FIG. 5B, and therefore the power switch 11 is off.

To sum up, the embodiments have disclosed the features used in the switch module of the present invention. The shrinkage of the pyrocondensation belt due to the heat is used to detect the temperature of the surge absorber, Before the surge absorber reaches the critical temperature which the surge absorber fails, the shrinkage of the pyrocondensation belt makes the power switch off, such that the surge absorber is automatically prevented from fire and the electronic components are protected accordingly.

The above-mentioned descriptions represent merely the exemplary embodiment of the present invention, without any intention to limit the scope of the present invention thereto. Various equivalent changes, alternations or modifications based on the claims of present invention are all consequently viewed as being embraced by the scope of the present invention.

What is claimed is:

1. A switch module, applied for a power supply system, comprising:

a power switch being connected to the power supply system;

an insulating member being set on the power switch, the insulating member having a push-pull portion and an extension portion;

a surge absorber being electrically connected to the power switch and adjacent to the power switch; and a pyrocondensation belt connecting the surge absorber and the push-pull portion of the insulating member, wherein the pyrocondensation belt is shrinkable in response to an increasing in temperature of the surge absorber for moving the insulating member;

wherein the insulating member does not affect the power switch when the insulating member is in an initial state;

and wherein the push-pull portion carries the extension portion to move in response to a force generated by the shrinkage of the pyrocondensation belt, thereby turning off the power switch.

2. The switch module as in claim 1, wherein the power switch is a rocker switch or a push switch.

3. The switch module as in claim 1, wherein the pyrocondensation belt is a pyrocondensation sleeve.

4. The switch module as in claim 1, wherein the power switch includes:

a casing;

a first conductive member inserting into the casing;

a second conductive member inserting into the casing; and an operation portion detachably disposed on the casing in order to alternate electrical connection and electrical disconnection between the first and second conductive members.

5. The switch module as in claim 4, wherein the push-pull portion is disposed outside the casing of the power switch while the extension portion is arranged inside the casing of the power switch; the extension portion is adjacent to the first and second conductive members.

6. The switch module as in claim 5, wherein the pyrocondensation belt surrounds the push-pull portion and the surge absorber.

7. The switch module as in claim 5, wherein the pyrocondensation belt surrounds the power switch, the push-pull portion and the surge absorber.

8. The switch module as in claim 1, wherein the pyrocondensation belt varies with a predetermined shrinkage rate while the pyrocondensation belt is in an operating temperature range; the maximum temperature in the operating temperature range is the critical temperature of the surge absorber, at which temperature the surge absorber fails.

9. A switch module, applied for a power supply system, comprising:

a power switch being connected to the power supply system;

an insulating member being set on the power switch, the insulating member having a push-pull portion and an extension portion;

a surge absorber being electrically connected with the power switch and adjacent to the power switch; and a pyrocondensation sleeve being sleeved onto an exterior periphery of the surge absorber and being connected to the push-pull portion of the insulating member;

wherein the pyrocondensation sleeve is shrinkable in response to an increasing in temperature of the surge absorber for moving the insulating member;

wherein the insulating member does not affect the power switch when the insulating member is in an initial state; and wherein the push-pull portion carries the extension portion to move in response to a force generated by the shrinkage of the pyrocondensation sleeve, thereby turning off the power switch.

10. The switch module as in claim 9, wherein the pyrocondensation sleeve varies with a predetermined shrinkage rate while the pyrocondensation sleeve is in an operating temperature range; the maximum temperature in the operating temperature range is the critical temperature of the surge absorber, at which temperature the surge absorber fails.

11. A switch module, applied for a power supply system, comprising:

a power switch being connected to the power supply system;

an insulating member being set on the power switch, the insulating member having a push-pull portion and an extension portion;

a surge absorber being electrically connected with the power switch and adjacent to the power switch; and a pyrocondensation sleeve being sleeved onto the surge absorber, the power switch, and the push-pull portion of the insulating member;

wherein the pyrocondensation sleeve is shrinkable in response to an increasing in temperature of the surge absorber for moving the insulating member;

wherein the insulating member does not affect the power switch when the insulating member is in an initial state; and wherein the push-pull portion carries the extension portion to move in response to a force generated by the shrinkage of the pyrocondensation sleeve, thereby turning off the power switch.

12. The switch module as in claim 11, wherein the pyrocondensation sleeve varies with a predetermined shrinkage rate while the pyrocondensation sleeve is in an operating temperature range; the maximum temperature in the operating temperature range is the critical temperature of the surge absorber, at which temperature the surge absorber fails.

* * * * *